US005819136A

United States Patent [19]

Tomita et al.

[11] Patent Number: 5,819,136

[45] Date of Patent: Oct. 6, 1998

[54] TEMPERATURE CONTROL FOR A FIXING DEVICE

[75] Inventors: Kan Tomita, Tokyo; Masaharu Furuya, Yokohama, both of Japan

[73] Assignee: Ricoh Company, Ltd., Tokyo, Japan

[21] Appl. No.: 835,431

[22] Filed: Apr. 9, 1997

[30] Foreign Application Priority Data

| | | | |
|---|---|---|---|
| Apr. 9, 1996 | [JP] | Japan | 8-086660 |
| Apr. 15, 1996 | [JP] | Japan | 8-092604 |
| Nov. 7, 1996 | [JP] | Japan | 8-295192 |

[51] Int. Cl.[6] ..... G03G 15/20

[52] U.S. Cl. ..... 399/69; 399/92

[58] Field of Search ..... 399/67, 69, 328, 399/335, 338, 92, 44; 219/216

[56] References Cited

U.S. PATENT DOCUMENTS

| | | | |
|---|---|---|---|
| 4,248,520 | 2/1981 | Kurita et al. | 399/92 |
| 4,556,779 | 12/1985 | Hashimoto et al. . | |
| 4,821,069 | 4/1989 | Kusumoto . | |
| 5,502,546 | 3/1996 | Muto | 399/44 |
| 5,561,512 | 10/1996 | Fukano et al. | 399/69 |
| 5,581,341 | 12/1996 | Tanaka | 399/69 |

FOREIGN PATENT DOCUMENTS 60-51872 3/1985 Japan .

7-77892 3/1995 Japan .

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

A control operation for a fixing device which may find application in an image forming apparatus such as a printer, facsimile, or copier machine, etc. The fixing device controls a temperature of a fixing element therein, for example a fixing roller, based on a calculated compensated temperature T' of the fixing roller, which is calculated based on detected temperature of the fixing element T0 and a reference environmental temperature T1 within the image forming apparatus according to the following equations:

$$T = C(T1) + f(T1)xT0 = g(T1) \times (T0)^2 + h(T1) \times (T0)^3 + \ldots \quad \text{(equation A)}$$

$$C(T1) = A1 = a1xT1 + b1x\,(T1)^2 + c1x\,(T1)^3 + \ldots$$

$$g(T1) = A2 + a2xT1 + b2x\,(T1)^2 + c2x\,(T1)^3 \ldots \quad \text{(equations B)}$$

$$h(T1) = A3 + a3xT1 + b3x\,(T1)^2 + c3x\,(T1)^3 \ldots,$$

in which each of A1–A4, a1–a4, b1–b4 and c1–c4 are constants. Experimental results have indicated that such a compensation temperature value T' closely approximates an actual temperature of the fixing element. Thus, with such an operation, a temperature of a fixing element can be controlled to an appropriate value.

19 Claims, 13 Drawing Sheets

TEMPERATURE CONTROL FOR A FIXING DEVICE

BACKGROUND OF THE INVENTION

1. Field of the Invention

The present invention is directed to a control of a temperature for a fixing device, and in which such a fixing device may find application in an image forming device.

2. Discussion of the Background

In an image forming device such as a printer, facsimile machine, copier machine, etc., a fixing device is often utilized to fix an image, for example a toner image, on an information recording medium, for example a paper sheet. Such a fixing device may as an example include a fixing roller which is heated to fix an image on a paper sheet. Such a fixing device may require a precise temperature control to control the temperature of the fixing device One disclosure of a system for controlling a temperature of a fixing device is disclosed in Japanese Publication No. 60-51872. In such a fixing device as disclosed in this Japanese Publication No. 60-51872, a non-contact thermal sensor is employed to sense a temperature of a fixing roller. An output of this non-contact thermal sensor is provided to thereby control the temperature of the fixing roller. The non-contact thermal sensor controls the temperature of the fixing roller so that a surface layer of the fixing roller is not damaged. Further, such a non-contact thermal sensor can provide a quick detection of a temperature of the fixing roller.

However, such a fixing device as disclosed in Japanese Publication No. 60-51872 employing the non-contact thermal sensor suffers from a drawback that such a non-contact thermal sensor can be easily influenced by environmental factors, such as an environmental temperature. A temperature internal to an image forming apparatus such as a copying machine may vary from 10° C. to 80° C., and a temperature near a fixing roller may vary from 10° C. to 200° C. Such a large temperature range influences the temperature control of the fixing roller in a device utilizing a non-contact thermal sensor such as disclosed in Japanese Publication No. 60-51872.

Japanese Publication No. 07-77892 discloses a further system for controlling a temperature of a fixing device. This Japanese Publication No. 07-77892 discloses a method for compensating a temperature of a fixing roller based on a detected temperature from a non-contact sensor. In this device, a conversion table is stored to compensate for errors which may arise, for example based on an environmental temperature, in the temperature detected by the non-contact sensor, so that a temperature detected by the non-contact sensor is precisely detected. However, such a device as disclosed in Japanese Publication No. 07-77892 suffers from a drawback in that if a detailed and precise compensation is required, a very large data table must be stored, which in turn requires a large memory and which delays determining the compensation amount for an actually detected temperature by the non-contact sensor.

SUMMARY OF THE INVENTION

Accordingly, one object of the present invention is to provide a novel temperature control operation for a fixing device which overcomes the drawbacks discussed above.

A more specific object of the present invention is to provide a novel temperature control operation for a fixing device which can compensate for external factors which may influence a detected temperature of a fixing device.

A more specific object of the present invention is to provide a novel temperature control for a fixing device which can perform a compensation quickly and without requiring a large memory.

The present invention achieves such objects by forming a temperature control device for a fixing device which includes a fixing element for fixing an image on an image recording medium. A sensor unit senses a temperature T0 of the fixing element and senses a reference environmental temperature T1.

A controller controls a temperature of the fixing roller based on a calculated compensated temperature value T' according to the equations:

(equation A)

$$T = C(T1) + f(T1)xT0 + g(T1)x(T0)^2 + h(T1)x(T0)^3 + \ldots$$

(equations B)

$$C(T1) = A1 + a1xT1 + b1x(T1)^2 + c1x(T1)^3 + \ldots$$

$$f(T1) = A2 + a2xT1 + b2x(T1)^2 + c2x(T1)^3 \ldots$$

$$g(T1) = A3 + a3xT1 + b3x(T1)^2 + c3x(T1)^3 \ldots$$

$$h(T1) = A4 + a4xT1 + b4x(T1)^2 + c4x(T1)^3 \ldots,$$

in which To indicates the sensed temperature of the fixing element from the sensor unit and T1 indicates a sensed reference environmental temperature from the sensor unit. Further A1–A4, a1–a4, b1–b4 and c1–c4 are constants.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
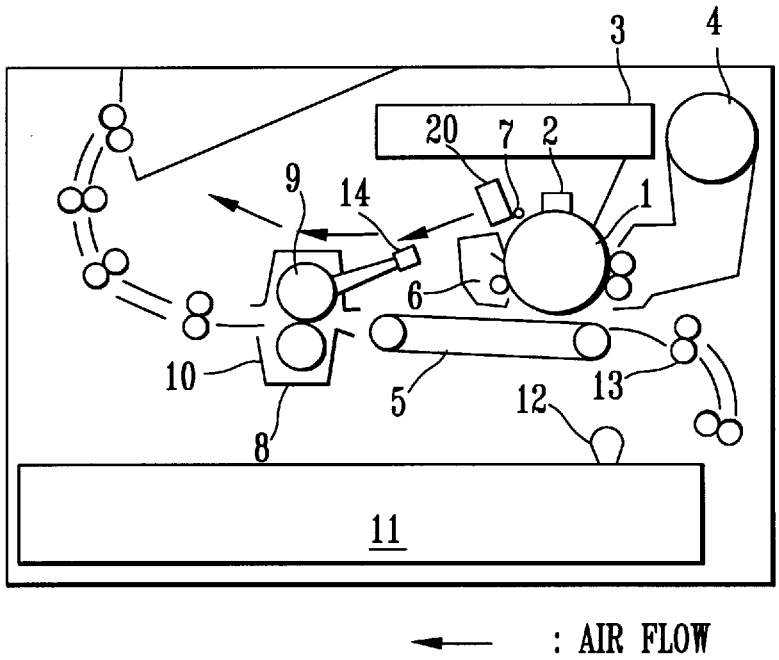
FIG. 1 shows an image processing apparatus according to an embodiment of the present invention.

Referring now to the accompanying drawings, wherein like reference numerals designate identical or corresponding parts throughout the several views, and more particularly to FIG. 1 thereof, a first embodiment of the present invention is shown.

The present invention is directed to temperature control of a fixing device used in an image forming apparatus such as a printer, a copier machine, a facsimile machine, etc.

In the embodiment of the present invention as shown in FIG. 1, the image forming apparatus includes a rotatable photosensitive drum 1 on which a latent image can be formed by a laser beam output from an exposure device 3. The laser beam from exposure device 3 exposes the photosensitive drum 1 to form the latent images thereon. A charger 2 is formed around the photosensitive drum 1 for charging the photosensitive drum 1 and a developing device 4 is formed around the photosensitive drum 1 for developing the latent image, for example with toner, formed on the photosensitive drum 1. A transfer belt 5 is also formed adjacent to the photosensitive drum 1.

An image recording medium, such as a paper sheet, is provided from a paper cassette 11 by a pick-up roller 12, and is thereby provided to a pair of register rollers 13. The image recording medium is then provided between the photosensitive drum 1 and transfer belt 5 to transfer the developed latent image from the photosensitive drum 1 onto the image recording medium. A cleaning device 6 is provided for removing toner from the photosensitive drum 1. A discharger 7 is provided for discharging a charge on the photosensitive drum 1.

After an image is transferred from the photosensitive drum 1 to an image recording medium, such as a paper sheet, the image recording medium is provided to a fixing device 8 for fixing the image thereon. This fixing device 8 may include a fixing roller 9 which includes a heat source. For example, this fixing roller 9 may include a halogen lamp or have a form of a self-heating type roller. The fixing roller 9 contacts a pressing roller 10.

This embodiment of the present invention as shown in FIG. 1 also includes a sensor unit 14 disposed between the fixing device 8 and the photosensitive drum 1. This sensor unit 14 faces the fixing roller 9 through an opening of a housing of the fixing device 8. The sensor unit 14 is provided to detect a temperature of the fixing roller 9, which detected temperature can be utilized as a feedback signal to control the temperature of the fixing roller 9, and to detect a reference environmental temperature of the image forming apparatus. The device of FIG. 1 also includes a fan 20 which can be activated to cool the sensor unit 14.

Figure 2:
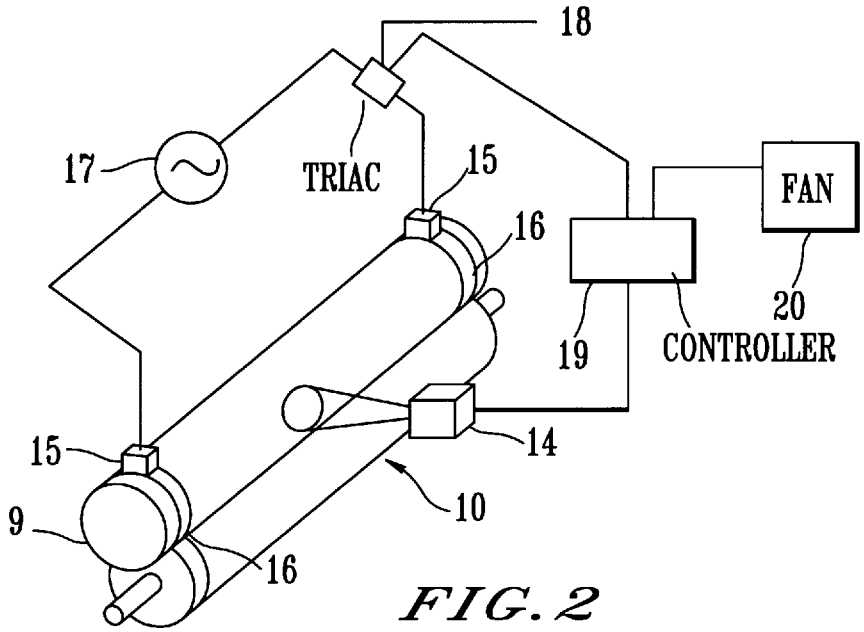
FIG. 2 shows an explanatory drawing of an embodiment of the present invention.
Figure 3:
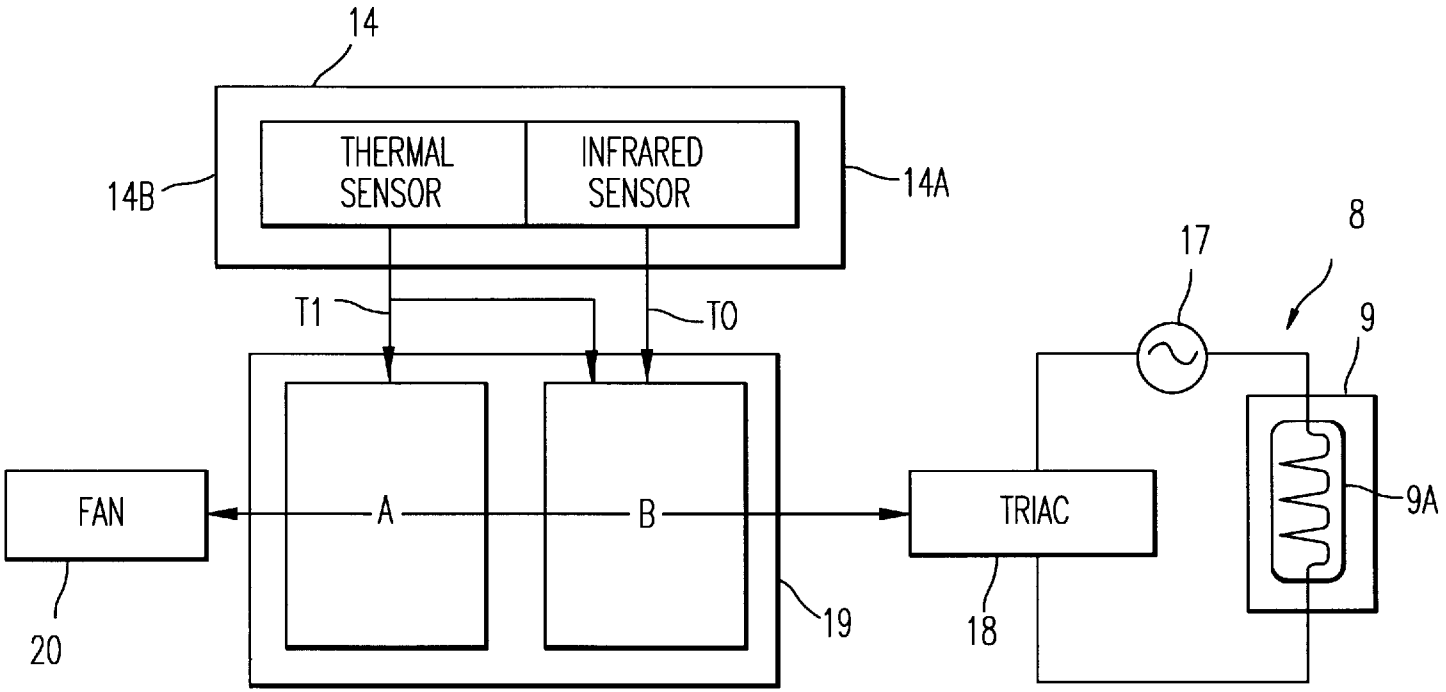
FIG. 3 shows a block diagram of control circuitry of an embodiment of the present invention.
Figure 4A:
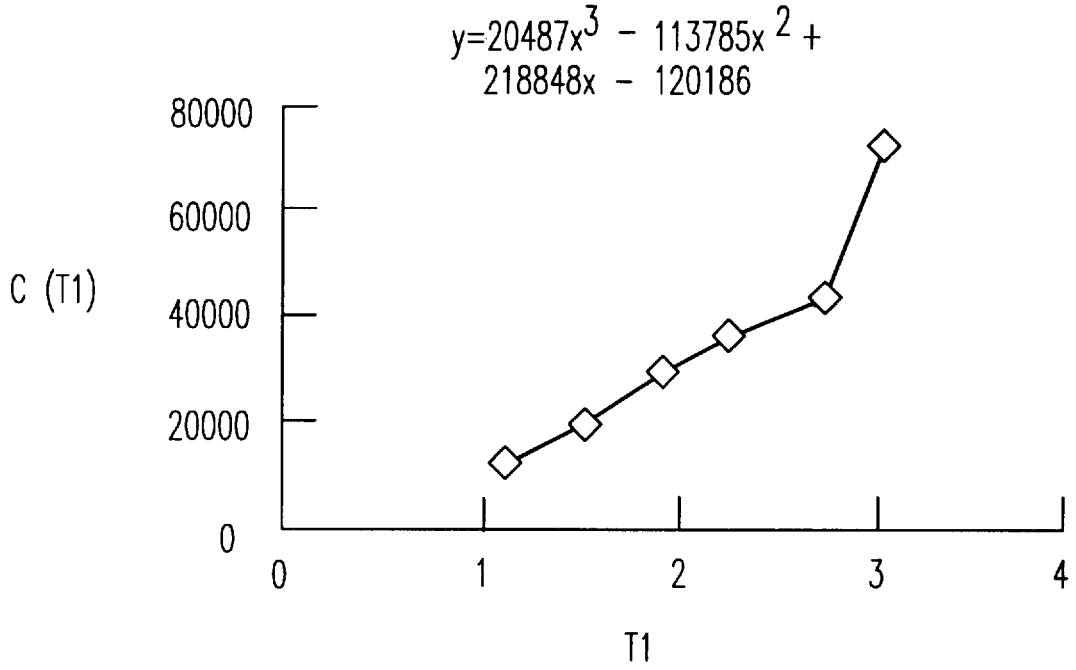
FIG. 4 shows test data utilized in developing an embodiment of the present invention.
Figure 4B:
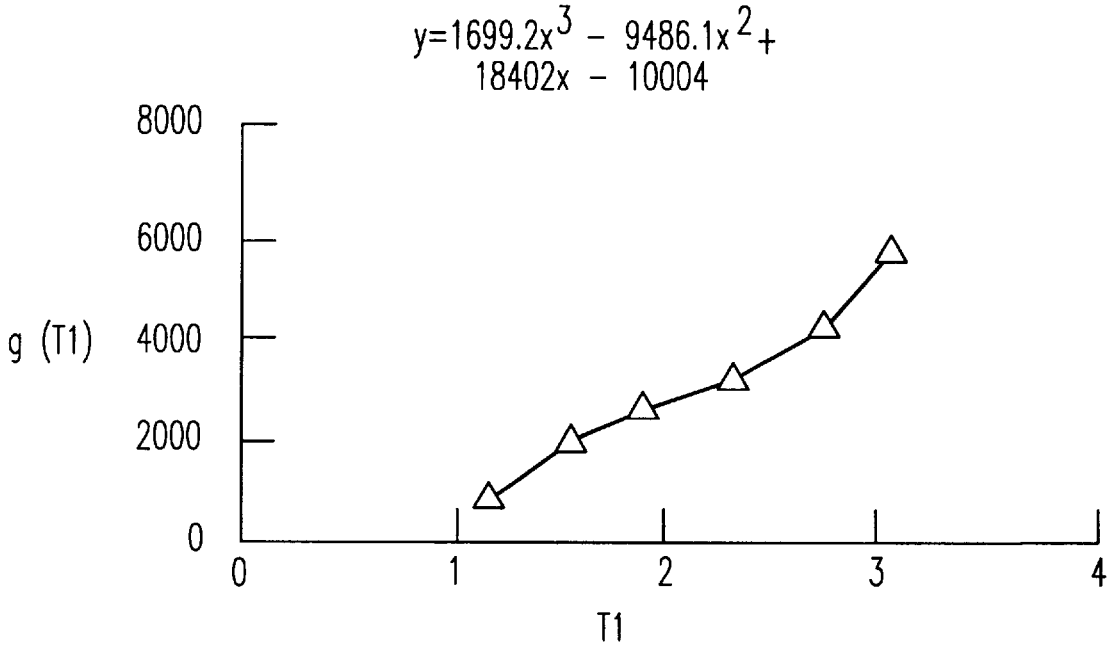
Figure 4C:
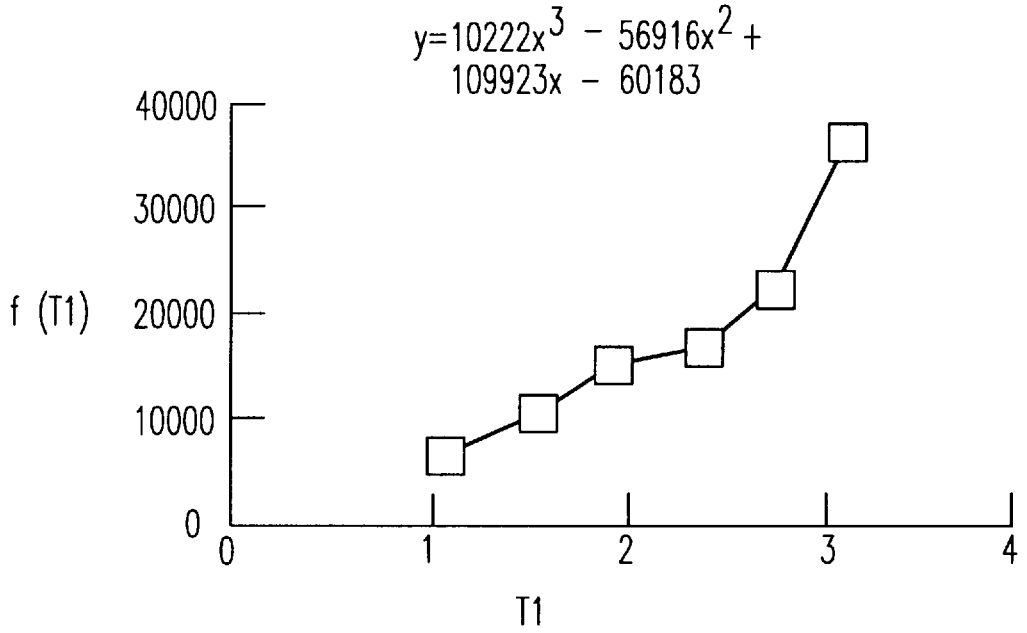
Figure 4D:
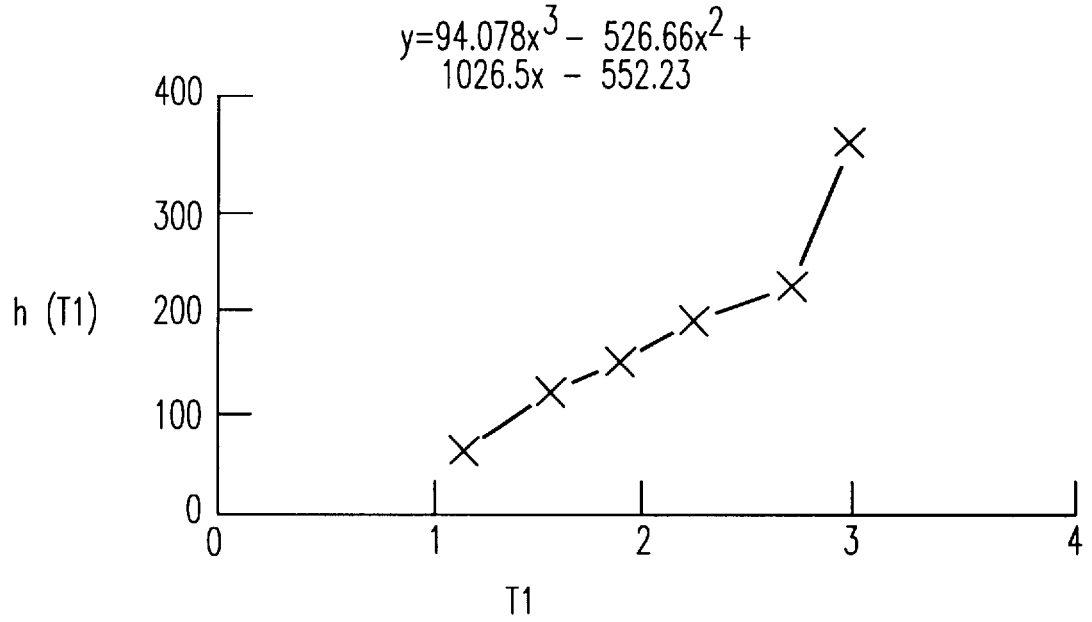

FIGS. 2 and 3 further explain an operation of the fixing device 8 and sensor unit 14 of FIG. 1. As shown in these FIGS. 2 and 3, the fixing roller 9 includes a heating device 9*a*, for example a halogen lamp. This fixing roller 9 also includes electrodes 16 which contact feed brushes 15 to effectuate the heating. Feed brushes 15 receive power from an AC power source 17 and one of the feed brushes 15 receives its power through a triac 18. The sensor unit 14 includes an infrared thermal sensor 14*a* for measuring a temperature of a surface of the fixing roller 9 and a thermal sensor 14*b* which measures a reference. This thermal sensor 146 outputs a first output signal T1 (indicating the detected referencing environmental temperature) which is supplied to two controller elements A, B in controller 19. The sensor unit 14 further includes the thermal sensor 14*b* which measures a reference environmental temperature. The infrared sensor 14*a* outputs a second output signal T0 (indicating the detected of fixing roller 9) to the controller element temperature B of controller 19.

The controller element A controls an on/off status and a rotating speed of the fan 20 based on the detected temperature T1 which provides an indication of a detected environmental temperature. The controller element B controls the AC power supply 17 supplying power to the fixing roller 9 through the triac 18 based on the output signal T1 indicating a reference environmental temperature and based on the output signal T0 indicating a detected temperature of the surface of the fixing roller 9. The signal output of controller B controls a temperature of the fixing roller 9 to ensure that a temperature of the fixing roller 9 is always within a required range.

The inventor of the present invention application performed tests to compare the detected output signal T0 providing an indication of the detected temperature of the surface of the fixing roller 9, the output signal T1 indicating a detected reference environmental temperature and an actual temperature T of the fixing roller 9, as sensed by another touch-type thermal sensor (not shown) mounted on fixing roller 9 for the experiment only. Based on such data, the inventor of the present application recognized that a calculated compensated value T' of the temperature of the fixing roller 9 (that is, a calculated value which factors in compensation information) is extremely similar to an actual detected temperature T of the fixing roller 9 if the detected output signals T0 and T1 are subject to the following equations A and B.

$$T = C(T1) + f(T1)xT0 + g(T1)x(T0)^2 + h(T1)x(T0)^3 + \ldots \quad \text{(equation A)}$$

$$C(T1) = A1 + a1xT1 + b1x(T1)^2 + c1x(T1)^3 + \ldots$$

$$f(T1) = A2 + a2xT1 + b2x(T1)^2 + c2x(T1)^3 \ldots \quad \text{(equations B)}$$

$$g(T1) = A3 + a3xT1 + b3x(T1)^2 + c3x(T1)^3 \ldots$$

$$h(T1) = A4 + a4xT1 + b4x(T1)^2 + c4x(T1)^3 \ldots,$$

in which each of A1–A4, a1–a4, b1–b4 and c1–c4 are constants.

The inventor arrived at the above-identified equations by the following procedure for the invention as shown in FIGS. 1–3.

First, the inventor gathered data such as is shown in the following Tables which compare the output signals T1, T0 with an actual measured value T of fixing roller 9.

TABLE 1

| T1 = 30° C. | | |
|---|---|---|
| T | V voltage (T0) | V voltage (T1) |
| 180° C. | −5.45 V | 1.17 V |
| 150° C. | −5.66 V | 1.17 V |
| 120° C. | −5.83 V | 1.17 V |
| 90° C. | −5.99 V | 1.17 V |
| 60° C. | −6.10 V | 1.17 V |
| 30° C. | −6.21 V | 1.17 V |

TABLE 2

| T1 = 40° C. | | |
|---|---|---|
| T | V voltage (T0) | V voltage (T1) |
| 180° C. | −5.56 V | 1.53 V |
| 150° C. | −5.75 V | 1.53 V |
| 120° C. | −5.90 V | 1.53 V |
| 90° C. | −6.04 V | 1.53 V |
| 60° C. | −6.15 V | 1.53 V |
| 30° C. | −6.24 V | 1.53 V |

TABLE 3

| T1 = 50° C. | | |
|---|---|---|
| T | V voltage (T0) | V voltage (T1) |
| 180° C. | −5.62 V | 1.92 V |
| 150° C. | −5.80 V | 1.92 V |
| 120° C. | −5.95 V | 1.92 V |
| 90° C. | −6.07 V | 1.92 V |
| 60° C. | −6.17 V | 1.92 V |
| 30° C. | −6.26 V | 1.92 V |

TABLE 4

| T1 = 60° C. | | |
|---|---|---|
| T | V voltage (T0) | V voltage (T1) |
| 180° C. | −5.69 V | 2.31 V |
| 150° C. | −5.84 V | 2.31 V |
| 120° C. | −5.98 V | 2.31 V |
| 90° C. | −6.08 V | 2.31 V |
| 60° C. | −6.18 V | 2.31 V |
| 30° C. | −6.27 V | 2.31 V |

TABLE 5

| T1 = 70° C. | | |
|---|---|---|
| T | V voltage (T0) | V voltage (T1) |
| 180° C. | −5.79 V | 2.70 V |
| 150° C. | −5.93 V | 2.70 V |
| 120° C. | −6.06 V | 2.70 V |
| 90° C. | −6.24 V | 2.70 V |
| 60° C. | −6.31 V | 2.70 V |
| 30° C. | −6.31 V | 2.70 V |

TABLE 6

| T1 = 80° C. | | |
|---|---|---|
| T | V voltage (T0) | V voltage (T1) |
| 180° C. | −5.84 V | 3.05 V |
| 150° C. | −5.98 V | 3.05 V |
| 120° C. | −6.09 V | 3.05 V |
| 90° C. | −6.19 V | 3.05 V |
| 60° C. | −6.27 V | 3.05 V |
| 30° C. | −6.33 V | 3.05 V |

Then, a degree number of the equations A and B was decided. In this embodiment of the present invention, each equation is a cubic equation.

The values from these Tables noted above were then input into the equations A and B noted above. When T1 equals 30° C., corresponding to Table 1 above, the values T and T0 are substituted into equation A as follows:

$$180^\circ\text{ C.} = C(30^\circ) + f(30^\circ)x(-5.45) + g(30^\circ)x(-5.45)^2 + h(30^\circ)x(-5.45)^3$$

$$150^\circ\text{ C.} = C(30^\circ) + f(30^\circ)x(-5.66) + g(30^\circ)x(-5.66)^2 + h(30^\circ)x(-5.66)^3$$

$$\cdots$$

$$30^\circ\text{ C.} = C(30^\circ) + f(30^\circ)x(-6.21) + g(30^\circ)x(-6.21)^2 + h(30^\circ)x(-6.21)^3$$

A number of equations which are equal in number to the number of the temperatures T were then generated. When four equations were selected, the coefficients (C, f, g, h) may be determined. Then, when another pair of four equations were picked among the equations, other values of the coefficients (C, f, g, h) were determined. After every combination of the four equations has been selected, the values of the coefficients (C, f, g,h) were determined by averaging the determined values Then, the temperature T1 was changed to a second temperature, for example where T1 equals 40° C. as shown in Table 2 above, and the coefficients (C, f, g, h) were then determined in the same manner as noted above. The temperature T1 was then changed to a next temperature, for example T1 equals 50° C. as shown in Table 3 above, and again each coefficient (C, f, g, h) was determined again in the same manner as noted above. Each value of these coefficients can then be plotted as shown in FIG. 4.

Each approximate equation for the coefficients (C, f, g, h) shown in FIG. 4 may be determined according to the plotted values shown in FIG. 4, so that the following approximate equations for the coefficients (C, f, g, h) can be calculated.

$$C(T1) = 20478x(T1)^3 - 113785x(T1)^2 + 218848x(T1) - 120186$$

$$g(T1) = 1699.2x(T1)^3 - 9486.1x(T1)^2 + 18402x(T1) - 10004$$

$$h(T1) = 94.078x(T1)^3 - 526.66x(T1)^2 + 1026.5x(T1) - 552.23$$

$$f(T1) = 10222x(T1)^3 - 56916x(T1)^2 + 109923x(T1) - 60183$$

Figure 5:
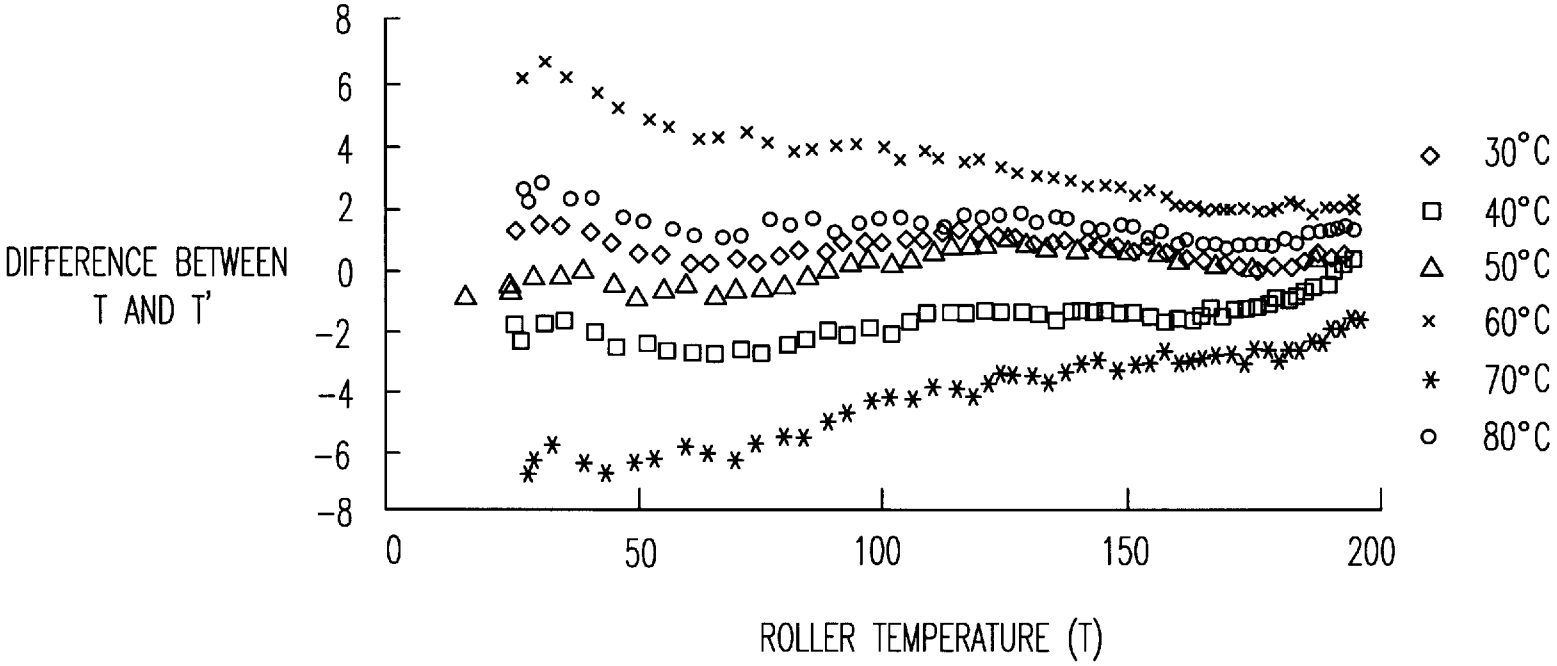
FIG. 5 shows a result of compensation achieved according to an embodiment of the present invention.

By utilizing the above-noted equations A and B in the present invention, when the sensed temperature T0 of the fixing roller 9 and sensed reference environmental temperature T1 are sensed by respective infrared sensor 14*a* and thermal sensor 14*b*, a compensated temperature value T' of the fixing roller 9 can be calculated by the equations A and B. That is, each coefficient (C, f, g, h) is calculated according to the equations B noted above and the sensed temperature T0 of the fixing roller 9. Then, the compensated temperature value T' of the fixing roller 9 is calculated according to the equation A and the sensed reference environmental temperature T1. This provides an accurate determination of the actual temperature of the fixing roller 9 in the present invention FIG. 5 shows a result when such a compensation method according to the present invention is implemented. FIG. 5 specifically shows differences between an actual temperature T of a fixing roller 9 and the calculated compensated temperature value T' based on the embodiment discussed above with reference to FIG. 4. As shown in FIG. 5, such differences are particularly small, especially in a range of between 180° C. to 200° C., which range corresponds to the operation range within which the fixing roller 9 is maintained while fixing an image, for example a toner image, onto an information recording medium, for example a sheet of paper. In this operation range between 180° to 200° C. of the fixing roller 9, the difference between an actual temperature T of the fixing roller 9 and the calculated compensated temperature T' is±3°.

Figure 6:
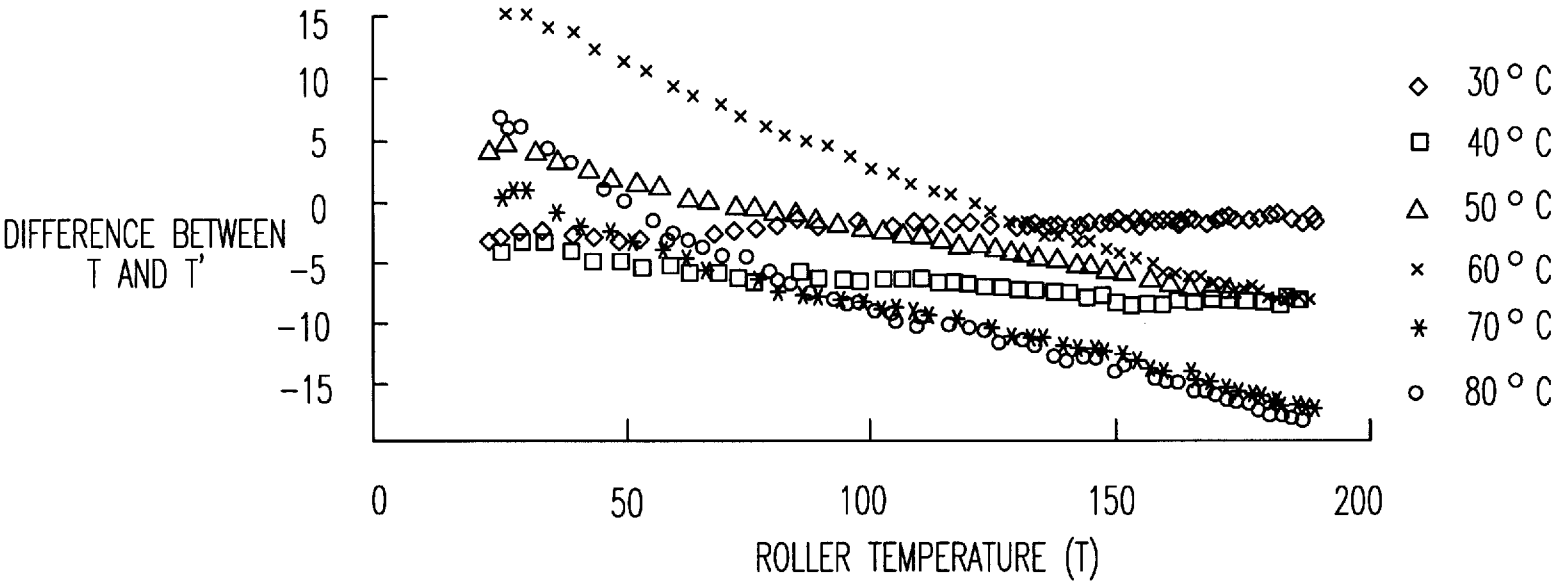
FIG. 6 shows a result of compensation achieved with a background device.
Figure 7A:
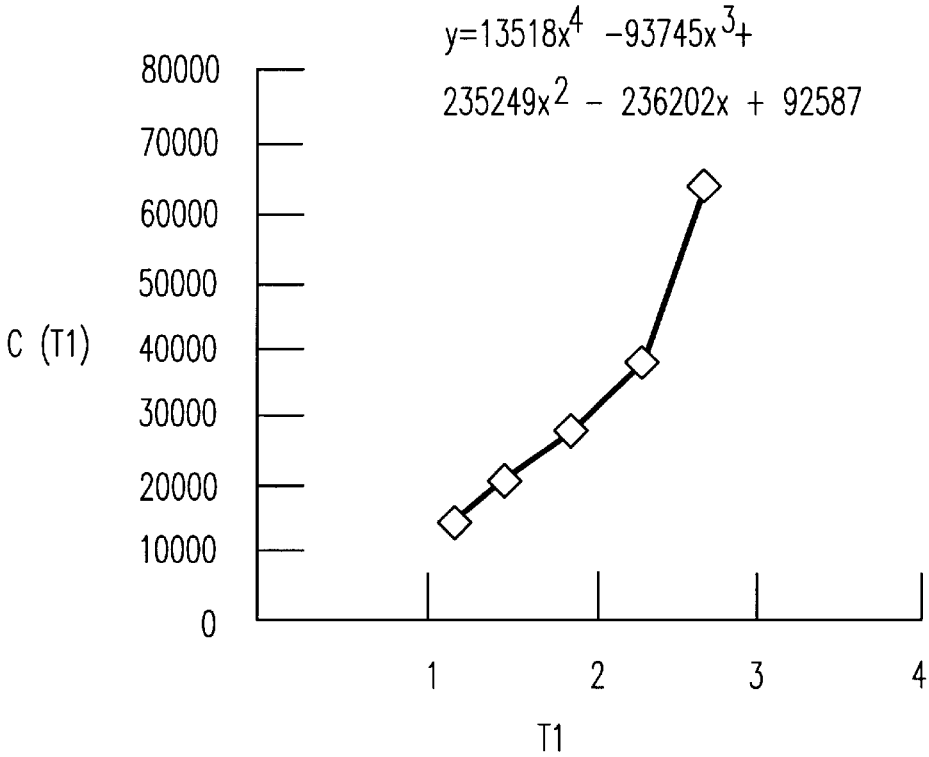
FIG. 7 shows test data utilized in developing a further embodiment of the present invention.
Figure 7B:
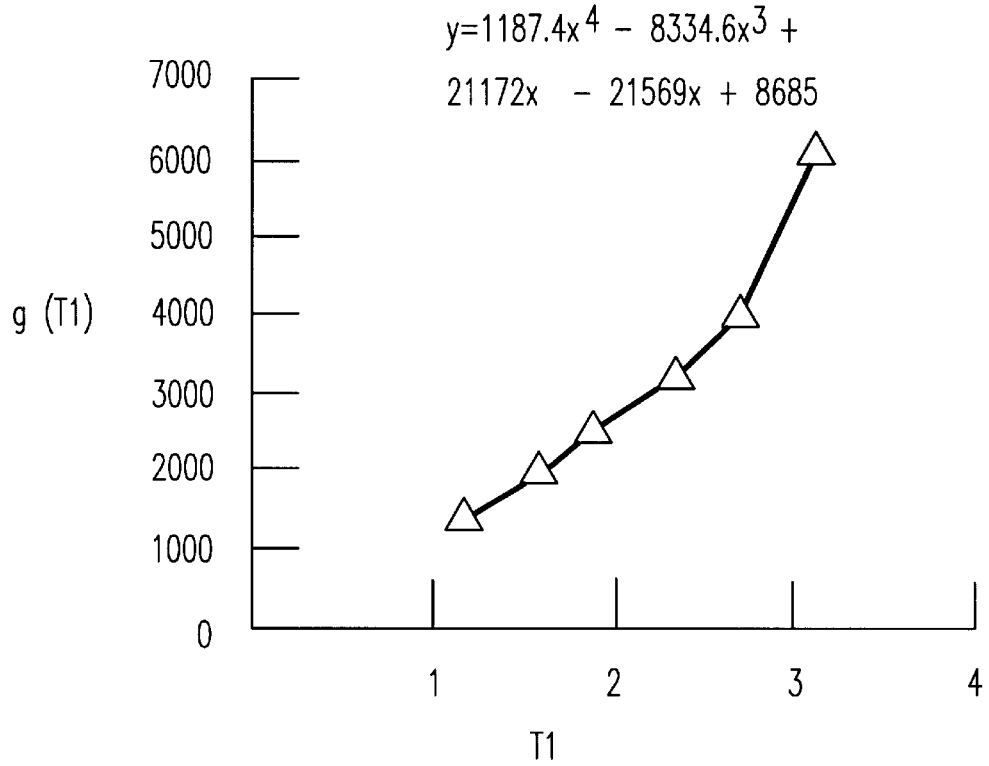
Figure 7C:
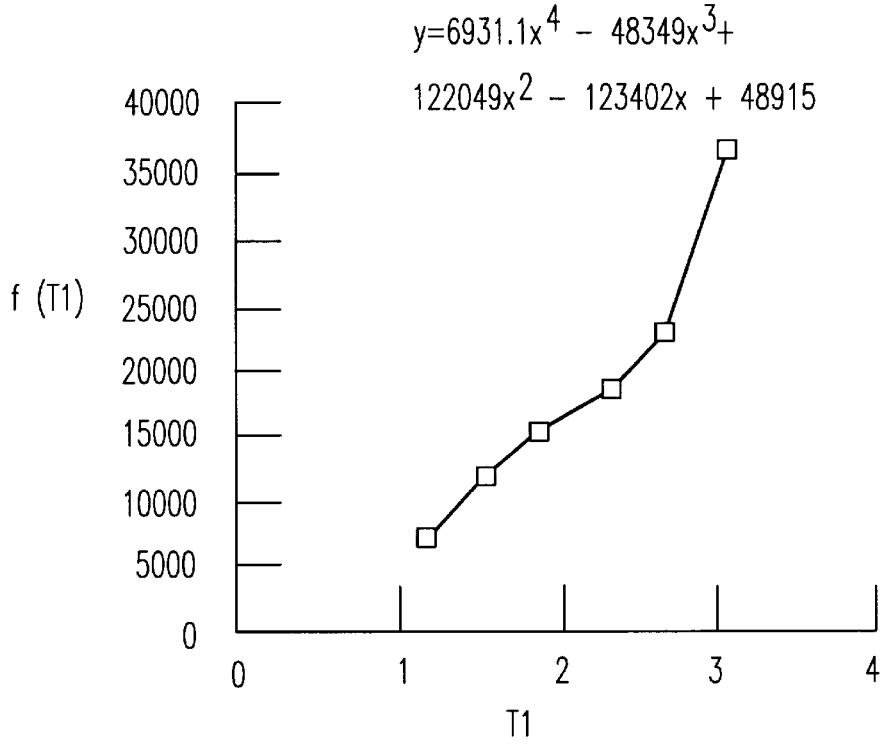
Figure 7D:
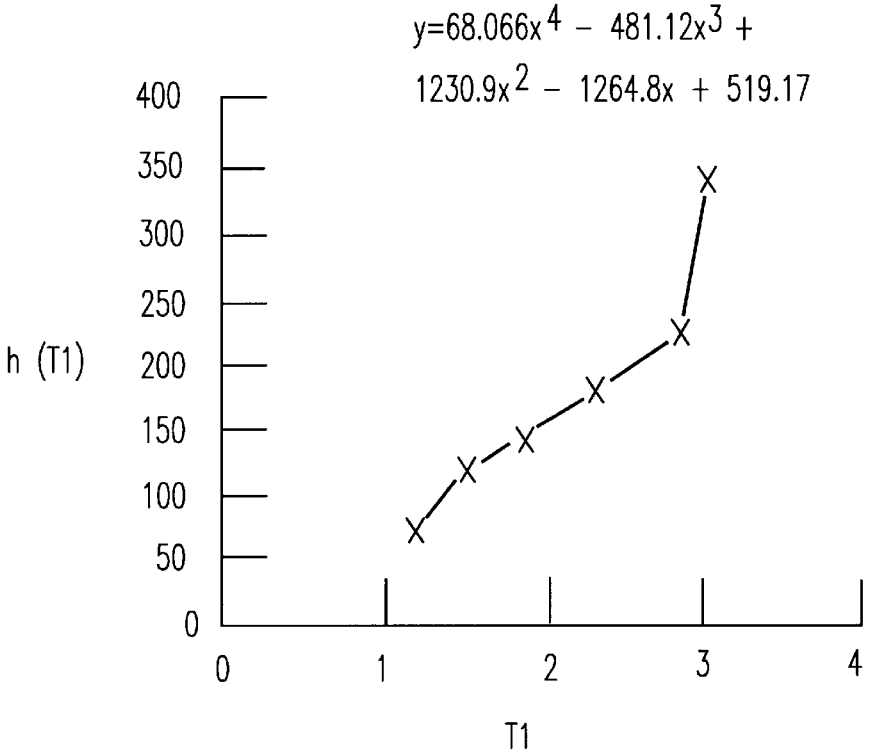

FIG. 6 shows a result of a compensation according to a background device such as is disclosed in Japanese Publication 60-51872. As is clear from FIG. 6, in such a background device a difference between an actual temperature T of a fixing roller and a compensated temperature T' are significantly larger than in the present invention as shown in FIG. 5.

FIG. 7 shows a further embodiment of the present invention. This embodiment of FIG. 7 differs from the previously discussed embodiment in that in this embodiment of FIG. 7 the equation B is determined to be a fourth order equation, and thus the equations A and B are as:

(equation A)

$$T' = C(T1) + f(T1)xT0 + g(T1)x(T0)^2 + h(T1)x(T0)^3 + \ldots$$

$$C(T1) = A1 + a1xT1 + b1x(T1)^2 + c1x(T1)^3 + d1x(T1)^4 \ldots$$

(equations B)

$$f(T1) = A2 + a2xT1 + b2x(T1)^2 + c2x(T1)^3 + d2x(T1)^4 \ldots$$

$$g(T1) = A3 + a3xT1 + b3x(T1)^2 + c3x(T1)^3 + d3x(T1)^4 \ldots$$

$$h(T1) = A4 + a4xT1 + b4x(T1)^2 + c4x(T1)^3 + d4x(T1)^4 \ldots,$$

Figure 8:
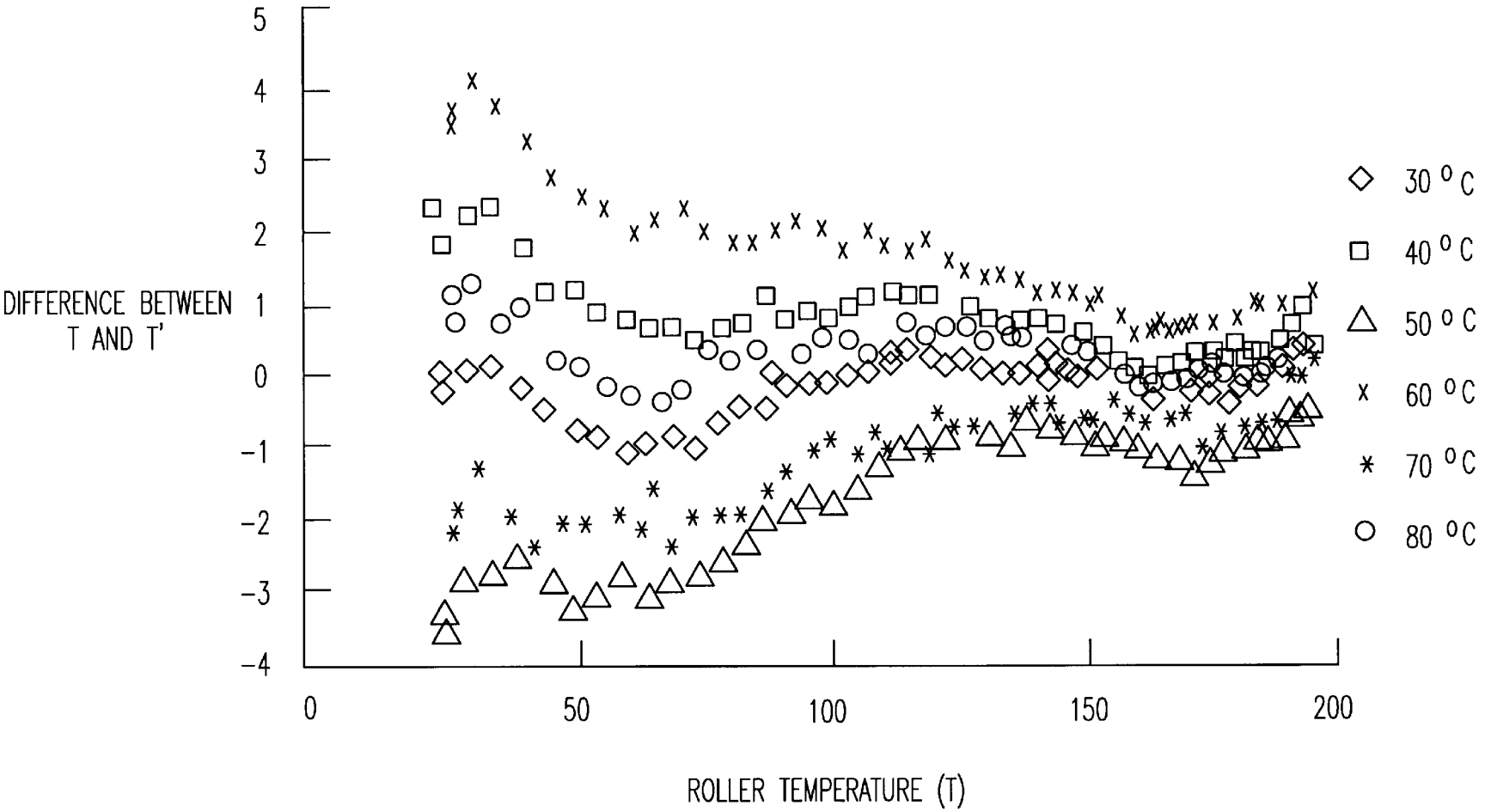
FIG. 8 shows a result of compensation achieved according to a further embodiment of the present invention.

FIG. 8 shows results achieved by utilizing a compensation with this further equation and with the embodiment as shown in FIG. 7. As shown in FIG. 8, in such a further embodiment of the present invention, a difference between an actual temperature T of fixing roller 9 and a calculated compensated temperature T' are even further reduced. As shown in FIG. 8, such a difference in the operation range of the fixing roller between 180° C. to 200° C. is within ±1°. In this way, the higher the degree number of the equations, the smaller the difference between an actual temperature value T of a fixing roller and a calculated compensation temperature T', although the more complicated and time consuming the calculations.

As noted above, controller element A of controller 19 controls fan 20. This control can be effectuated such that, as one example only, the fan 20 is controlled to slowly rotate at a first speed when the detected temperature T0 of the fixing roller 9 is between 40° C. to 60° C., and the fan 20 is controlled to rapidly rotate at a second faster speed when the detected temperature T0 of the fixing roller 9 is between 60° C. to 80° C. When the temperature T0 of fixing roller 9 is detected as being greater than 80° C., the fan 20 may be turned off as this may indicate a machine error. With this operation of the present invention, as the sensed temperature of the fixing roller 9 increases, the speed of rotation fan 20 can be increased, to increase a cooling effect of the fan 20.

Figure 9:
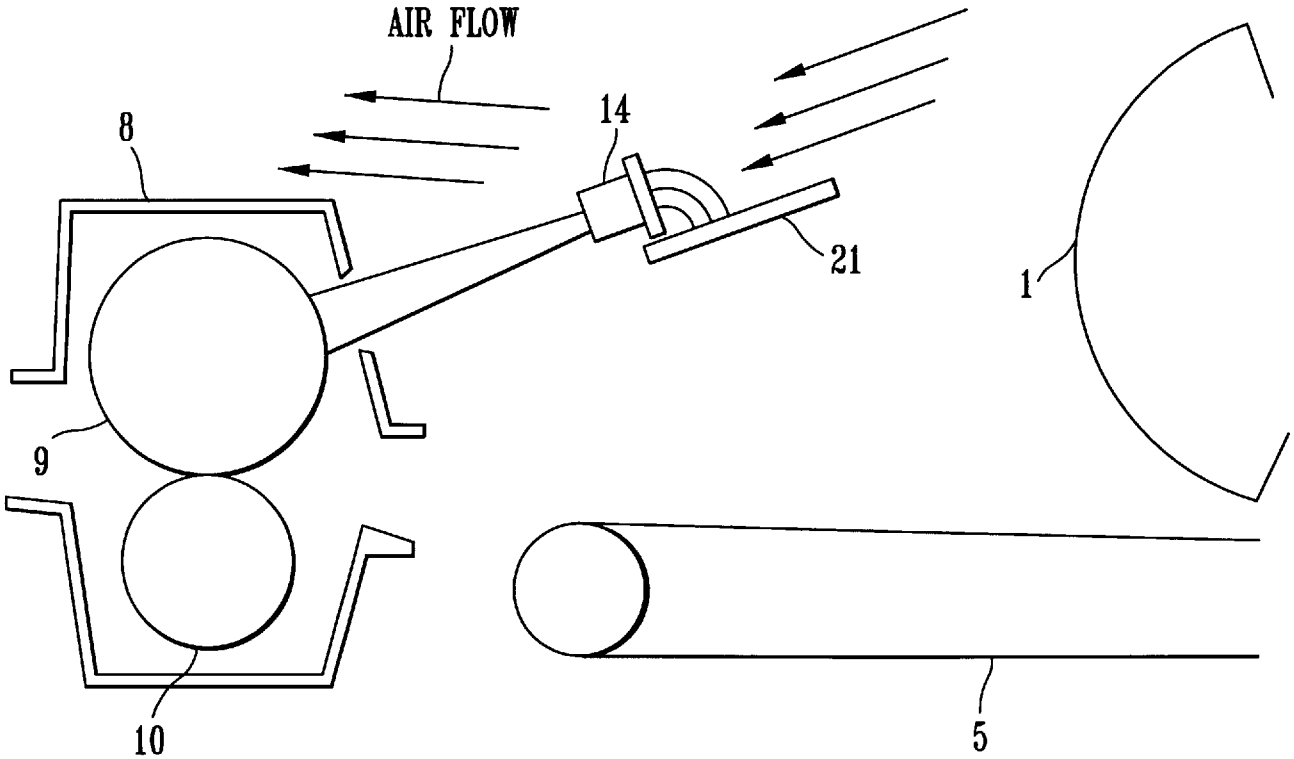
FIG. 9 shows a further embodiment of one feature of present invention.
Figure 12:
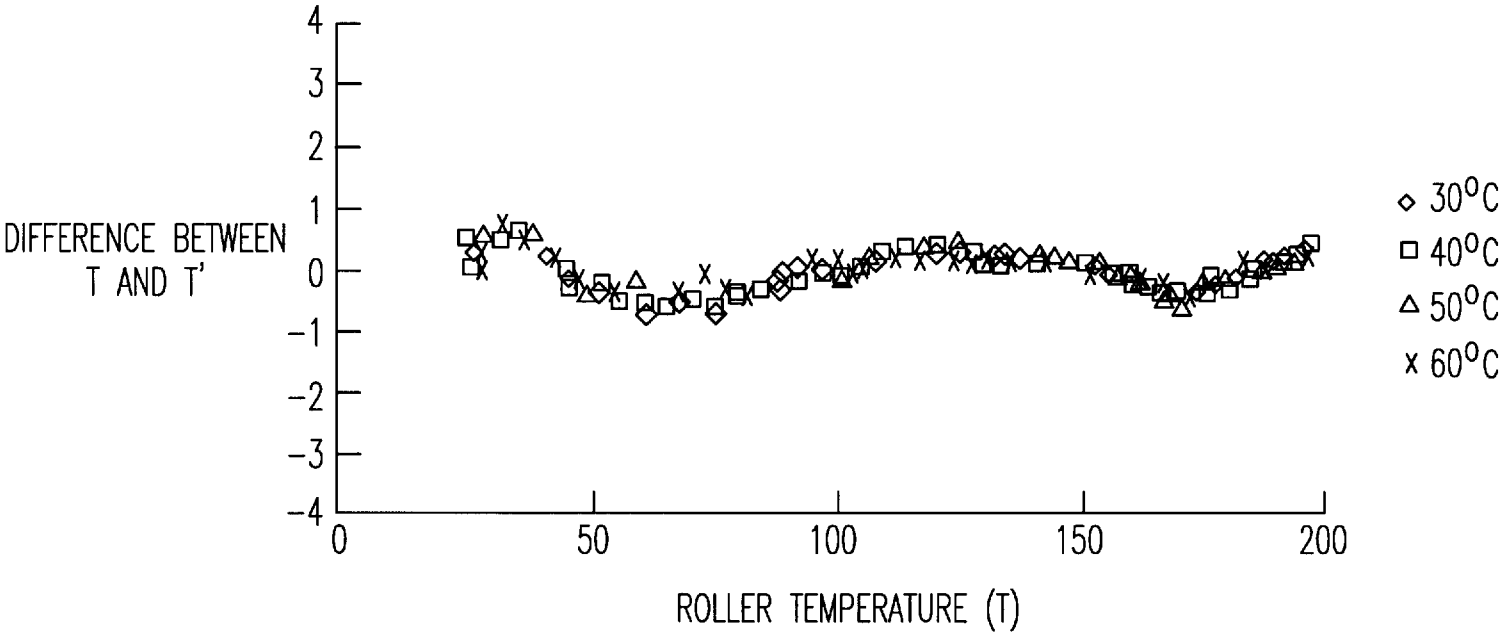
FIG. 12 shows a chart of temperature difference compared to a roller temperature in a fixing device according to the present invention.

FIG. 9 shows a further embodiment of one feature of the present invention in which the sensor unit 14 is attached to a circuit board 21. In this further embodiment of the present invention as shown in FIG. 9, a direction at which the sensor unit 14 faces the fixing roller 9 is parallel to the board 21, so that air from fan 20 flows to the sensor unit 14. As a result, in this embodiment of FIG. 9 a temperature of the sensor unit 14 itself is better maintained within a predetermined range, for example between 30° C. and 60° C. If such a further structure is applied to the sensor unit 14, a difference between an actual temperature T of fixing roller 9 and a calculated compensated temperature T' can be further reduced A result of such a compensation of the embodiment of FIG. 9 is shown in FIG. 12, which clearly shows that a difference between an actual temperature T of fixing roller 9 and a calculated compensated temperature T' are very small.

Figure 10:
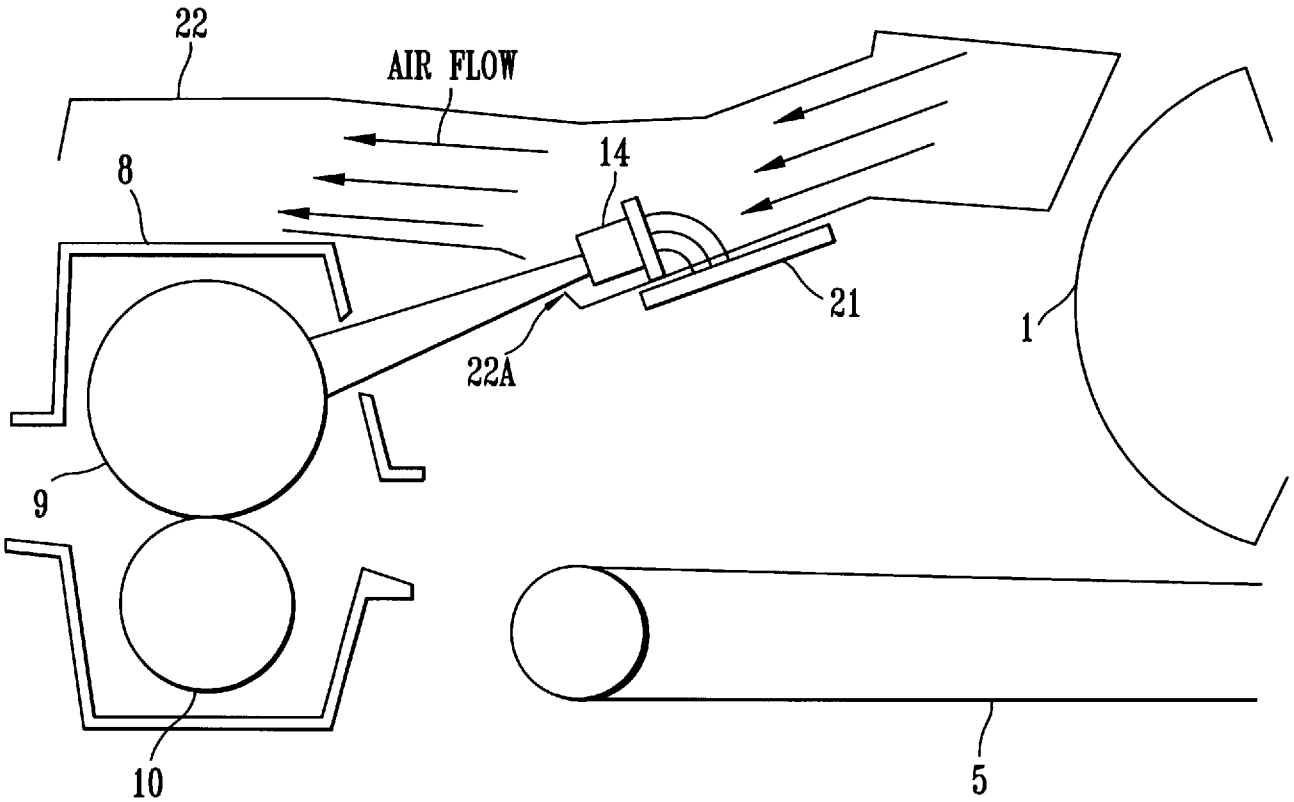
FIG. 10 shows a further embodiment of one feature of the present invention.

FIG. 10 shows a further embodiment of one feature of the present invention in which an air duct 22 for airflow is provided from fan 20 to sensor unit 14, which duct 22 includes an opening or transparent portion 22*a* so that sensor unit 14 can still face fixing roller 9. With such a structure as shown in FIG. 10, the use of the air duct 22 provides air flow from the fan 20 to the sensor unit 14 to be more effective.

Figure 11:
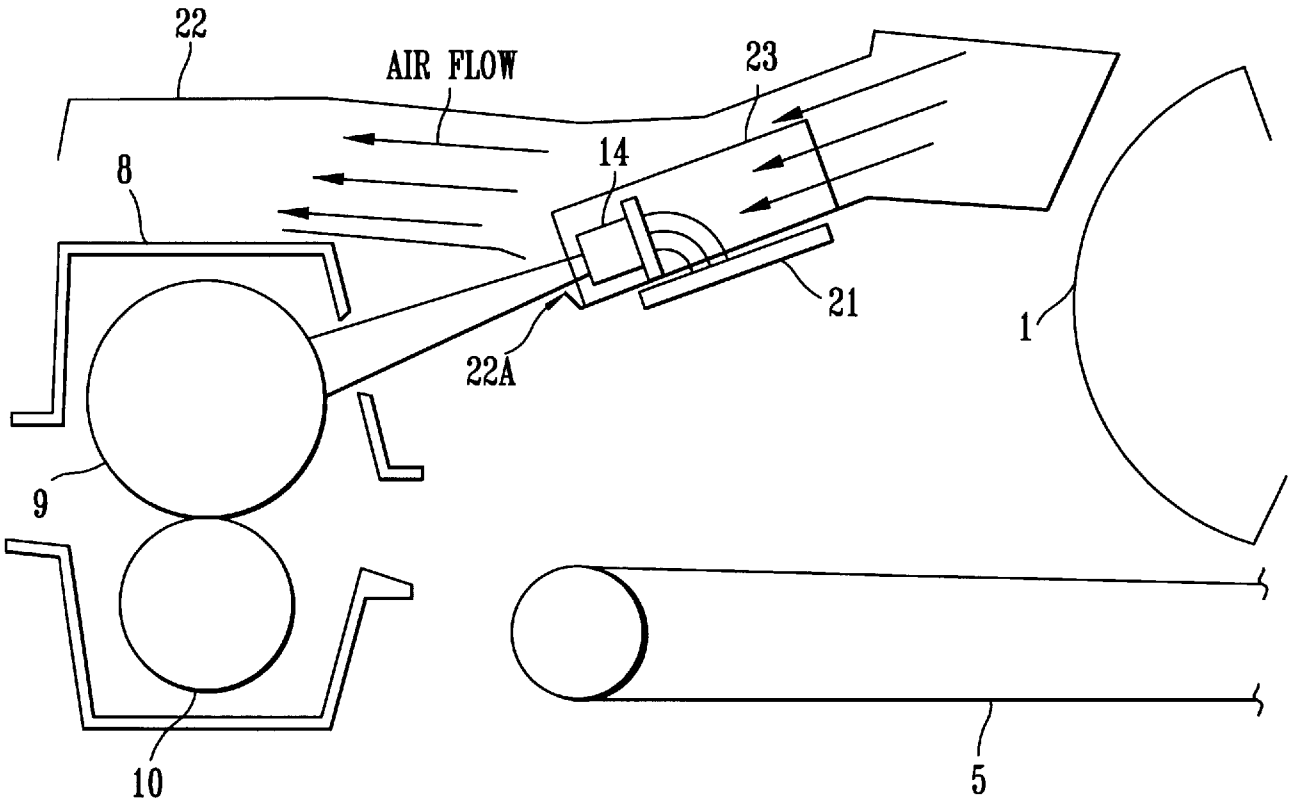
FIG. 11 shows a further embodiment of one feature of the present invention.

FIG. 11 shows a further embodiment of one feature of the present invention which further includes a plate 23 for radiating heat of the sensor unit 14 formed on circuit board 21. The introduction of this radiating plate 23 allows air to flow to the sensor unit 14 more effectively.

Obviously, numerous additional modifications and variations of the present invention are possible in light of the above teachings. It is therefore to be understood that within the scope of the appended claims, the present invention may be practiced otherwise than as specifically described herein.

The present application is based on Japanese priority documents 08-86660, 08-92604 and 08-295192, the contents of which are herein incorporated by reference.

What is claimed as new and is desired to be secured by Letters Patent of the United States is:

1. A temperature control device for a fixing device including a fixing element for fixing an image on an image recording medium, comprising:

a sensor unit sensing a temperature T0 of the fixing element and sensing a reference environmental temperature T1;

a controller controlling a temperature of the fixing element based on a calculated compensation temperature value T' according to:

$$T' = C(T1) + f(T1)xT0 + g(T1) \times (T0)^2 + h(T1) \times (T0)^3 + \ldots \quad \text{(equation A)}$$

$$C(T1) = A1 + a1xT1 + b1x\,(T1)^2 + c1x\,(T1)^3 + \ldots$$

$$f(T1) = A2 + as2Tx1 + b2x\,(T1)^2 + c2x\,(T1)^3 \ldots \quad \text{(equations B)}$$

$$g(T1) = A3 + a3xT1 + b3x\,(T1)^2 + c3x\,(T1)^3 \ldots$$

$$h(T1) = A4 + a4xT1 + b4x\,(T1)^2 + c4x\,(T1)^3 \ldots$$

wherein T0 indicates the sensed temperature of the fixing element, T1 indicates the sensed reference environmental temperature, and A1–A4, a1–a4, b1–b4 and c1–c4 are all constants.

2. The temperature control device according to claim 1, further comprising a circuit board on which the sensor unit is mounted.

3. The temperature control device according to claim 1, further comprising a fan blowing air onto the sensor unit, and a duct controlling air flow from the fan towards the sensor unit.

4. The temperature control device according to claim 1, further comprising a radiating plate at the sensor unit.

5. The temperature control device according to claim 1, further comprising a fan for blowing air onto the sensor unit, and wherein the controller further controls the fan based on the calculated temperature value T'.

6. The temperature control device according to claim 5, further comprising a circuit board on which the sensor unit is mounted.

7. The temperature control device according to claim 5, further comprising a duct controlling air flow from the fan towards the sensor unit.

8. The temperature control device according to claim 5, further comprising a radiating plate at the sensor unit.

9. A temperature control device for a fixing device including a fixing element for fixing an image on an image recording medium, comprising:

sensor means for sensing a temperature T0 of the fixing element and for sensing a reference environmental temperature T1;

control means for controlling a temperature of the fixing element based on a calculated compensation temperature value T' according to:

$$T' = C(T1) + f(T1)xT0 + g(T1) \times (T0)^2 + h(T1) \times (T0)^3 + \ldots \quad \text{(equation A)}$$

$$C(T1) = A1 + a1xT1 + b1x\,(T1)^2 + c1x\,(T1)^3 + \ldots$$

$$f(T1) = A2 + as2Tx1 + b2x\,(T1)^2 + c2x\,(T1)^3 \ldots \quad \text{(equations B)}$$

$$g(T1) = A3 + a3xT1 + b3x\,(T1)^2 + c3x\,(T1)^3 \ldots$$

$$h(T1) = A4 + a4xT1 + b4x\,(T1)^2 + c4x\,(T1)^3 \ldots$$

wherein T0 indicates the sensed temperature of the fixing element, T1 indicates the sensed reference environmental temperature, and A1–A4, a1–a4, b1–b4 and c1–c4 are all constants.

10. The temperature control device according to claim 9, further comprising a circuit board means for supporting the sensor means.

11. The temperature control device according to claim 9, further comprising an air blowing means for blowing air onto the sensor means, and a duct means for controlling air flow from the air blowing means towards the sensor means.

12. The temperature control device according to claim 9, further comprising a radiating means for radiation at the sensor means.

13. The temperature control device according to claim 9, further comprising an air blowing means for blowing air onto the sensor means, and wherein the control means further controls the air blowing means based on the calculated temperature value T'.

14. The temperature control device according to claim 13, further comprising a circuit board means for supporting the sensor means.

15. The temperature control device according to claim 13, further comprising a duct means for controlling air flow from the air blowing means towards the sensor means.

16. The temperature control device according to claim 13, further comprising a radiating means for radiation at the sensor means.

17. A method of controlling temperature of a fixing device for fixing an image on an image recording medium, comprising the steps of:

sensing a temperature T0 of a fixing element and sensing a reference environmental temperature T1, by a sensor unit;

controlling a temperature of the fixing element based on a calculated temperature value T' according to:

$$T' = C(T1) + f(T1)xT0 + g(T1) \times (T0)^2 + h(T1) \times (T0)^3 + \ldots \quad \text{(equation A)}$$

$$C(T1) = A1 + a1xT1 + b1x\,(T1)^2 + c1x\,(T1)^3 + \ldots$$

$$f(T1) = A2 + as2Tx1 + b2x\,(T1)^2 + c2x\,(T1)^3 \ldots \quad \text{(equations B)}$$

$$g(T1) = A3 + a3xT1 + b3x\,(T1)^2 + c3x\,(T1)^3 \ldots$$

$$h(T1) = A4 + a4xT1 + b4x\,(T1)^2 + c4x\,(T1)^3 \ldots$$

wherein T0 indicates the sensed temperature of the fixing element, T1 indicates the sensed reference environmental temperature, and A1–A4, a1–a4, b1–b4 and c1–c4 are all constants.

18. The temperature control method according to claim 17, further comprising the step of blowing air onto the sensor unit through a duct for controlling the air flow from a fan towards the sensor unit.

19. The temperature control method according to claim 17, further comprising the steps of blowing air onto the sensor unit, and controlling the blown air based on the calculated temperature value T'.

* * * * *